US008779883B2

(12) United States Patent
Kobayashi et al.

(10) Patent No.: US 8,779,883 B2
(45) Date of Patent: Jul. 15, 2014

(54) COIL DEVICE

(75) Inventors: Katsumi Kobayashi, Tokyo (JP); Hiroshi Maeda, Tokyo (JP); Kiho Hwang, Seoul (KR)

(73) Assignees: TDK Corporation, Tokyo (JP); TDK Korea Corporation, Seoul (KR)

( * ) Notice: Subject to any disclaimer, the term of this patent is extended or adjusted under 35 U.S.C. 154(b) by 0 days.

(21) Appl. No.: 13/543,501

(22) Filed: Jul. 6, 2012

(65) Prior Publication Data

US 2013/0049913 A1 Feb. 28, 2013

(30) Foreign Application Priority Data

Jul. 6, 2011 (JP) ..... 2011-150201

(51) Int. Cl.

| | |
|---|---|
| ***H01F 27/30*** | (2006.01) |
| ***H01F 27/29*** | (2006.01) |
| ***H01F 27/24*** | (2006.01) |
| ***H01F 27/02*** | (2006.01) |

(52) U.S. Cl.

CPC ..... *H01F 27/027* (2013.01)
USPC ..... 336/198; 336/192; 336/208; 336/212

(58) Field of Classification Search

USPC ..... 336/198, 208, 192, 212, 222, 182, 136, 336/220, 221

See application file for complete search history.

(56) References Cited

U.S. PATENT DOCUMENTS

| | | | | | |
|---|---|---|---|---|---|
| 1,730,240 | A | * | 10/1929 | Piper | 336/121 |
| 3,652,968 | A | * | 3/1972 | Johnston et al. | 336/170 |
| 4,257,027 | A | * | 3/1981 | Yasuhisa | 336/192 |
| 4,857,877 | A | * | 8/1989 | Dethienne | 336/170 |
| 5,673,013 | A | * | 9/1997 | Moody et al. | 336/192 |
| 6,002,319 | A | * | 12/1999 | Honma | 336/73 |
| 6,154,113 | A | * | 11/2000 | Murai | 336/198 |
| 6,344,786 | B1 | * | 2/2002 | Chin | 336/198 |
| 7,764,157 | B2 | * | 7/2010 | Schulz et al. | 336/198 |
| 8,018,314 | B2 | * | 9/2011 | Zeng et al. | 336/208 |
| 2008/0100407 | A1 | | 5/2008 | Yamaguchi et al. | |

FOREIGN PATENT DOCUMENTS

| | | |
|---|---|---|
| JP | 2008-112753 | 5/2008 |

* cited by examiner

*Primary Examiner* — Alexander Talpalatski
*Assistant Examiner* — Mangtin Lian
(74) *Attorney, Agent, or Firm* — Muncy, Geissler, Olds & Lowe, P.C.

(57) ABSTRACT

A coil device 10 comprises a bobbin 40 having a bobbin plate 42 provided with a first hollow cylinder 44 on which a primary coil 20 is wound, and a case 50 provided with a second hollow cylinder 54 wound by a secondary coil 30 at the outer circumference. On the bobbin plate 42, a primary terminal 70 connecting to the primary coil 20 and a secondary terminal 72 connecting to the secondary coil 30 are formed, and a tip end portion 55*a* of case 50 is extended to the end portion of the bobbin plate 42 to which the secondary terminal 72 is formed. Further, on the tip end portion 55*a*, plural first grooves 57*a* for lead are formed.

9 Claims, 9 Drawing Sheets

COIL DEVICE

BACKGROUND OF THE INVENTION

1. Field of the Invention

The present invention relates to a coil device preferably used for a resonance transformer and the like.

2. Description of the Related Art

Coil devices are used in various electrical products for various uses. For instance, when driving a backlight of liquid crystal display, an inverter resonance transformer is used to obtain a high-voltage.

A resonance transformer is requested to realize outward requirements such as low height profile, in addition to electric characteristics such as occurrence of suitable leakage inductance. In order to meet such requirements, prior art proposes a coil device which is a horizontal-type wherein the axis direction of core is parallel to the mounting surface, and which is a split structure wherein a primary coil and a secondary coil are separately arranged along the axis direction of core. Further, there is advantage that the coil device of the split structure is relatively easy to insulate.

However, the coil device according to prior arts has problems that a leakage flux occurs toward a downward direction of a mounting surface of the coil device or toward an upward direction. For instance, as for a resonance transformer used for a backlight of liquid crystal display television, constructional materials including iron and the like may be disposed upward and downward directions of the coil device. With this, it brings problems that a leakage flux from the coil device causes eddy current in constructional material and the like, and then heat or noise associated with said occurrence of eddy current are caused. Further, in order to prevent such leakage flux toward upward and downward directions, it is possible to implement an aluminum board on upward and downward directions of the coil device. However, with this implement, heat dissipation of a coil may be deteriorated.

In order to resolve the above problems, the applicant has proposed a coil device to realize low height profile of a coil device, by combining a bobbin plate to which a primary coil winds and a case to which a secondary coil winds, and then disposing the secondary coil at the outer circumference of the primary coil.

However, in regard with the coil device under development, it is necessary to pull and connect a lead part of the secondary coil which is wound around a case to a secondary terminal which is formed at an end portion of the bobbin plate. Currently, there is a problem that it is difficult to automate that operation.

[Patent Document 1] Japanese Patent Publication No. 2008-112753.

SUMMARY OF THE INVENTION

The present invention has been made by considering the above circumstances, and a purpose of the present invention is to provide a coil device which enables low height profile, and enables to easily connect a lead part of coil and a terminal.

In order to achieve the above purpose, a coil device according to the present invention comprising, a bobbin having a bobbin plate provided with a first hollow cylinder, on which a primary coil is wound at the outer circumference, and a case provided with a second hollow cylinder readily mounted on the outer circumference of said primary coil and wound by a secondary coil at the outer circumference, and provided with a lower collar part which is formed at the lower end of said second hollow cylinder so as to be mounted on the upper surface of the bobbin plate, wherein;

a primary terminal connecting to said primary coil and a secondary terminal connecting to said secondary coil are formed on said bobbin plate, and a tip end portion of the lower collar part of said case at a side of the secondary terminal is extended at least to the end portion of said bobbin plate to which said secondary terminal is formed, and plural first grooves for leads, which guide a lead wire of said secondary coil to a connection part with said secondary terminal, are formed on said tip end portion.

In the coil device according to the present invention, it enables to shorten the length of the axial direction of the first hollow cylinder on which the primary coil is wound and also of the second hollow cylinder on which the secondary coil is wound since the secondary coil is arranged at the outer circumference of the primary coil. These lengths of the axial direction correspond to a height of coil device. Therefore, it enables low height profile of coil device. Further, the case determining a part of an outer shape also serves as a bobbin of the secondary coil. Therefore, it enables to reduce the number of parts with a double structure.

Further, in order to form the primary terminal and the secondary terminal on the bobbin plate, there is no need to form terminals on the case. With this, it enables to flexibly design a shape of case, and the design flexibility is increased and also low height profile becomes easy. Along with that, it enables to select relatively economical resin for case, and also enables a reduction of production cost compared with the bobbin. Further, for the bobbin wherein the terminals are formed, a heat resistance is required in order for solder treatment to the terminals.

Further, in the present invention, a tip end portion on the side of the secondary terminal of the lower collar part of case is extended to the end portion of the bobbin plate wherein the secondary terminal is formed, and plural first groves for leads, which guides a lead wire of the secondary coil to a connection part with the secondary terminal, is formed on this tip end portion. With this, it is possible for the end portion of lead wire of coil winding around the outer circumference of the second hollow cylinder to hook on the first grooves for leads, so that the process of wiring the lead wire around the secondary terminal becomes easy, and that enables to automate easily that process.

In addition, by hooking the lead wires which are mutually adjacent on the first grooves for different leads, insulation characteristics of mutual lead wires can be well maintained. Further, the lead wire itself is insulated by the use of insulating coating and the like. Therefore, plural lead wires may be engaged on the same first groove for lead.

Further, in the present invention, the term "groove" is used including the concept of cutout or other concave parts. Furthermore, in the present invention, the description "a tip end portion on the side of the secondary terminal of the lower collar part of case is extended at least to the end portion of the bobbin plate" does not indicate that the end portion of the bobbin plate and the tip end portion of the lower collar part at the side of the secondary terminal are accurately aligned. It indicates that "the tip end portion of the lower collar part of case at the side of the secondary terminal is extended at least close to the end portion of the bobbin plate".

On the end portion of said bobbin plate, a second groove for lead further guiding said lead wire, which is guided by said first groove for lead, to a connection part with said secondary terminal may be formed. Further, the tip end portion of the lower collar part of said case at the side of the secondary terminal may be extended at least to the position where it overlaps with said second groove for lead. In that case, it is possible for the end portion of lead wire to hook on the first groove and the second groove for leads, so that the process of wiring the lead wire around the secondary terminal becomes easy.

Further, the tip end portion of the lower collar part of said case at the side of the secondary terminal may projects, either equaling or surpassing the end portion of said bobbin plate. The process that the end portion of lead wire hooks on the first groove for lead to wire the lead wire around the secondary terminal is easy, without forming the second groove for lead on the end portion of the bobbin plate since the first groove for lead is formed on the tip end portion of the projected lower collar part at the side of the secondary terminal. It is not necessary to form the second groove for lead on the end portion of the bobbin plate and it becomes easy to form the bobbin plate itself. With this, it enables a reduction of production cost and also an improvement of the strength of the bobbin plate.

It is preferable that said first grooves for lead are formed on the tip end portion of said lower collar part at the side of the secondary terminal along the end portion of said bobbin plate. When plural secondary terminals are arranged along the end portion of the bobbin plate, the process that the end portion of lead wire hooks on the first groove for lead to wire the lead wire around the secondary terminal becomes easy.

Although it is preferable to form the first grooves for lead corresponding to the number of the secondary terminals, it is not necessarily to correspond exactly to the number of the secondary terminals. For instance, one of the first grooves for lead may be formed corresponding to plural secondary terminals.

It is preferable that an upper collar part is formed on the upper end of said second hollow cylinder of said case. It enables to wire the secondary coil around the outer circumference of said second hollow cylinder which is located between the upper collar part and the lower collar part.

On the outer circumference of said second hollow cylinder which is located between said upper collar part and the lower collar part, at least one intermediate collar part may be formed. By wiring the secondary coil around the outer circumference of the second hollow cylinder which is located between these collar parts, it enables to arrange the secondary coil with dividing it into plural parts.

It is preferable that a tip end portion of said intermediate collar part is extended to the end portion of said bobbin plate wherein said secondary terminal is formed. Further, it is preferable that a third groove for lead, guiding the lead wire of said secondary coil to the connection part with said secondary terminal, is formed. In that case, the process that the end portion of lead wire hooks on the third groove and the first groove for lead to wire around the second terminal becomes easier.

Preferably, middle legs of a pair of ferrite cores are respectively inserted into a through hole of said first hollow cylinder, from top and bottom of said first hollow cylinder. Further, side legs and base portions of the pair of ferrite cores are assembled to cover a part of said case and bobbin from the outer circumference.

The coil device on which such ferrite cores are attached enables to make leakage flux toward upward and downward directions small, and to suppress occurrence of eddy current and occurrence of heat and noise associated with the occurrence of eddy current in surrounding parts. Further, it is not necessary to place aluminum board and the like to prevent leakage flux. With this, a preferable heat dissipation characteristic can be obtained. Furthermore, with the structure wherein the secondary coil is arranged at the outer circumference of the primary coil, it enables to shorten the length of middle leg and side leg of core and to well maintain the strength and the impact strength characteristic of coil device.

The distance between the outer perimeter edge of said primary coil and the inner perimeter edge of said secondary coil may be changed along the circumferential direction. With this, pulling around of wire to the primary coil can be performed by using an area where the distance between the outer perimeter edge of the primary coil and the inner perimeter edge of the secondary coil is large. Therefore, although a coil device has a double structure wherein the secondary coil goes around the outer circumference of the primary coil, it provides a preferable insulation characteristic.

Further, the primary coil may be bilaterally symmetric with respect to the reference axis, and the secondary coil may be bilaterally asymmetric with respect to said reference axis.

When the secondary coil is bilaterally asymmetric with respect to the reference axis, an area, where the distance between the outer perimeter edge of the primary coil and the inner perimeter edge of the secondary coil is large, can be formed at a place distant from the core. Such coil device enables to lengthen the creepage distance between wire and core by wiring the primary coil with using an area where the distance between the outer perimeter edge of the primary coil and the inner perimeter edge of the secondary coil is large, and also enables to obtain preferable insulation characteristics.

Further, for instance, a winding shape of the secondary coil may be an egg-shape that comprises a winding bottom located on one end portion of the major axis, and a winding top located on the other end portion of the major axis with a larger curvature than that of the winding bottom. Furthermore, the secondary coil may be placed so that the major axis is perpendicular to said reference axis, and the winding top of the secondary coil may be placed more distant from the outer perimeter edge of the primary coil compared with the winding bottom.

Such coil device forms an area, where the distance between the outer perimeter edge of the primary coil and the inner perimeter edge of the secondary coil is large, between the winding top of the secondary coil and the primary coil. The winding top is positioned on the end portion of the major axis perpedicular to the first direction, and the distance from the core is long. Therefore, such coil device enables to provide preferable insulation characteristic by lengthening the creepage distance between the wire and the core. Further, by making a shape of the secondary coil as an egg shape, the length of the wire can be suppressed compared with an ellipse shape and the like.

Further, for instance, a connecting path, which communicates from an external area to an area formed between the outer perimeter edge of the primary coil and the inner perimeter edge of the secondary coil, may be formed in the bobbin plate. Furthermore, a lead wire, which connects the primary coil and the primary terminal, may pass through the connecting path.

Such coil device enables to make the creepage distance between the core and the lead wire large, and to make a length of the lead wire short.

The lead wire, which connects the primary coil and the primary terminal, may comprise a horizontal lead part and a vertical lead part, the horizontal lead part is placed between the outer perimeter edge of the primary coil and the inner perimeter edge of the secondary coil and is pulled out from the outer perimeter edge of the primary coil in the direction parallel to the mounting surface, the vertical lead part is pulled out from the horizontal lead part in the direction perpendicular to the mounting surface.

Such coil device includes lead parts comprising a horizontal lead part and a vertical lead part. Therefore, it enables to make the creepage distance between the core and the lead wire large and to obtaine preferable insulation characteristic.

BRIEF DESCRIPTION OF THE DRAWINGS

The following is the explanation of the present invention based on the embodiments shown in Figures.

DESCRIPTION OF THE PREFERRED EMBODIMENTS

First Embodiment

Figure 1:
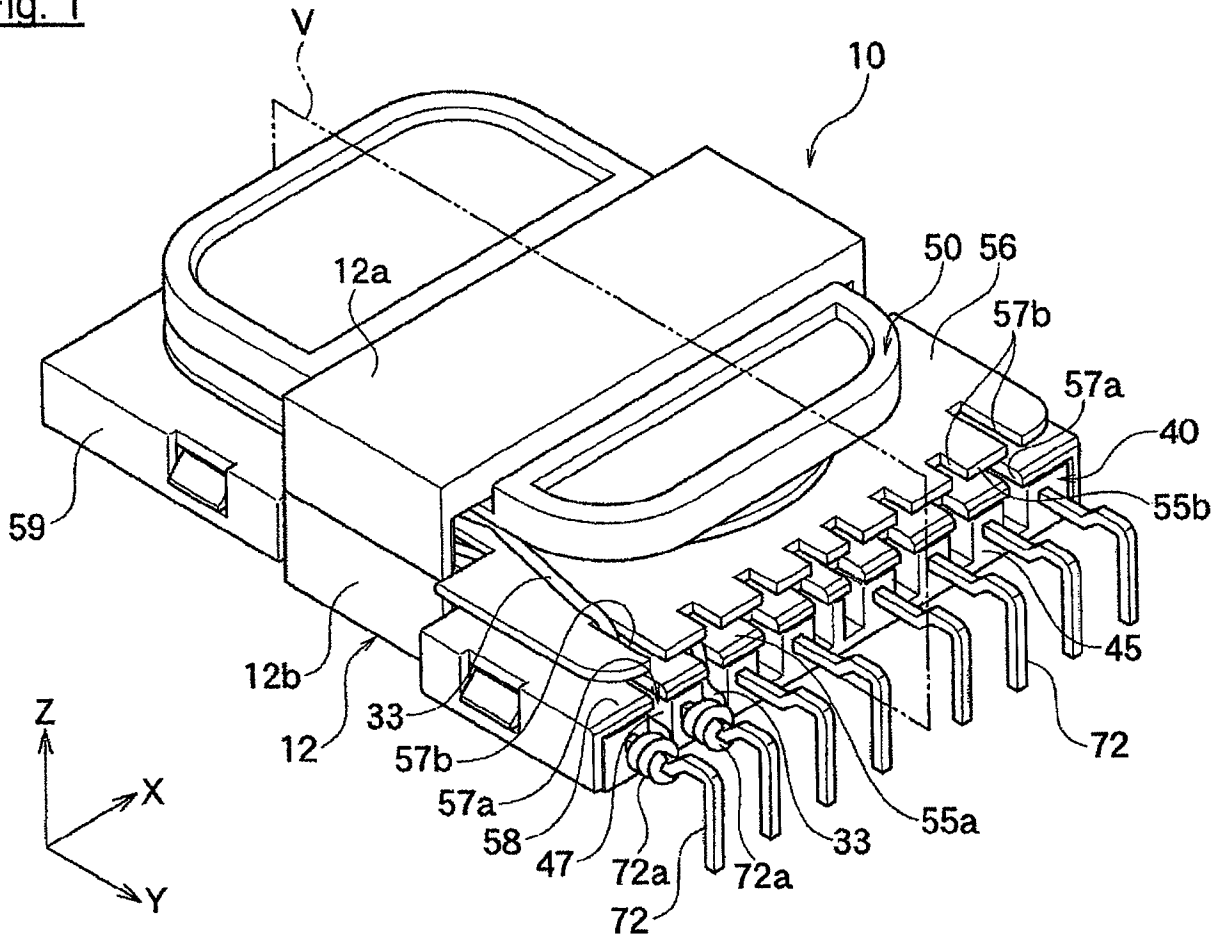
FIG. 1 is an overall perspective view of a coil device according to a first embodiment of the present invention.

As shown in FIG. 1, a coil device 10 according to a first embodiment of the present invention comprises a core 12, a bobbin 40 and a case 50.

The core 12 of the coil device 10 forms a flux path where flux generated from a coil described later passes. It is formed by assembling the first core 12*a* and the second core 12*b*, which are separately formed. The first core 12*a* and the second core 12*b* have symmetrical shape and they are attached to each other, sandwiching the case 50 and the bobbin 40 from upward and downward directions (Z-axis direction in FIG. 1).

Figure 2:
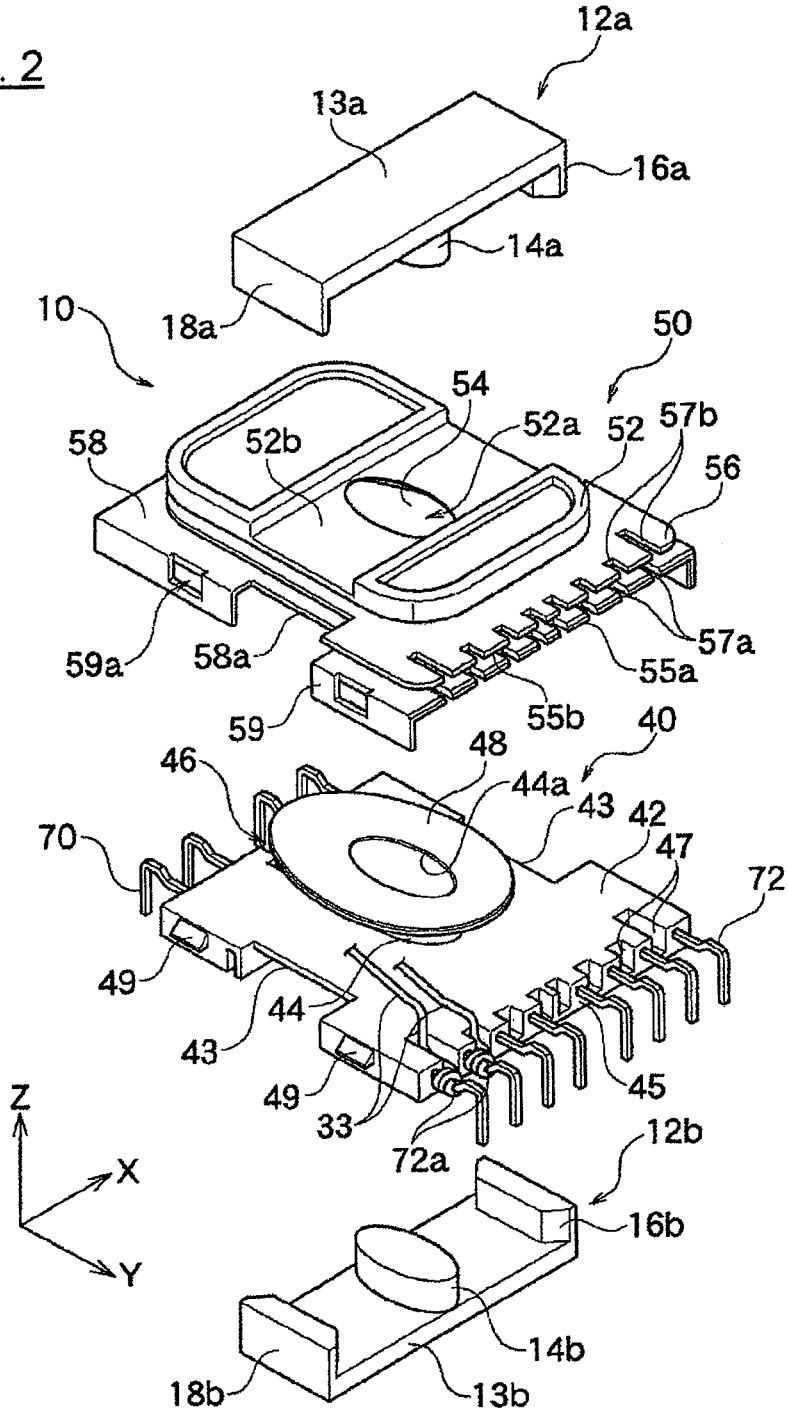
FIG. 2 is an exploded perspective view of a coil device shown in FIG. 1.

As shown in FIG. 1, the core 12 comprises the first core 12*a* and the second core 12*b* respectively having a generally E-shaped cross-sectional view (cut section including X-axis and Y-axis in FIG. 1). As shown in FIG. 2, each core 12 a and 12*b* is composed of ferrite cores and comprises planer base portions 13*a*, 13*b* extending in the X-axis direction, side legs 16*a*, 16*b*, 18*a*, 18*b* projecting from both ends of X-axis direction of each base portions 13*a*, 13*b* to the Z-axis direction, and middle legs 14*a*, 14*b* projecting from an intermediate position of X-axis direction of each base portions 13*a*, 13*b* to the Z-axis direction.

Further, in Figures, Z-axis shows a height direction of the coil device 10, and it enables low height profile of the coil device as the height of Z-axis direction in the coil device 10 becomes lower. Furthermore, X-axis and Y-axis are perpendicular to each other and also are perpendicular to Z-axis. In this embodiment, X-axis corresponds to a an array direction of a secondary terminal 72 and a longitudinal direction of the core 12, and Y-axis corresponds to a longitudinal direction of the coil device 10.

As shown in FIG. 2, the bobbin 40 comprises a rectangular planar bobbin plate 42. A bottom side of the bobbin plate 42 is a mounting surface of the coil device. On one end portion of the Y-axis direction of the bobbin plate 42, plural primary terminals 70 (in an illustrative embodiment, 4 primary terminals are fixed) are fixed at predetermined intervals along the X-axis direction. Further, on the other end portion 45 of the Y-axis direction of the bobbin plate 42, plural secondary terminals 72 (in an illustrative embodiment, 8 secondary terminals are fixed) are fixed at predetermined intervals along the X-axis direction.

These terminals 70 and 72 are composed of, for instance, metal plate terminal and they are integrally formed by an insert molding procedure and the like with respect to the bobbin plate 42 which is composed of insulation materials such as synthetic resins. As described later, a lead part of the primary coil 20 is connected to the primary terminal 70, and a lead part of the secondary coil 30 is connected to the secondary terminal 72.

A first hollow cylinder 44 is formed projecting along the Z-axis direction in the middle position on the surface of the bobbin plate 42. A bobbin collar 48 is formed on the upper end of the first hollow cylinder 44. The bobbin collar 48 projects, along the plane of the X-Y axes, from the upper end of the first hollow cylinder 44 to a radical direction, and has a function to hold a primary coil 20. It is preferable that the bobbin plate 42, the first hollow cylinder 44 and the bobbin collar 48 are integrally formed by an injection molding and the like.

A through hole 44*a* is formed penetrating the bobbin plate 42, the first hollow cylinder 44 and the bobbin collar 48 in the Z-axis direction. A cross-sectional shape of the through hole 44*a* corresponds to that of a through hole 52*a* formed on a case 50 which is described later. Further, the cross-section has an elliptical shape that enables a middle leg 14*b* (the same with 14*a*/hereinafter the same) on a core 12*b* (the same with 12*a*/hereinafter the same) to insert, as shown in FIG. 6.

Figure 5:
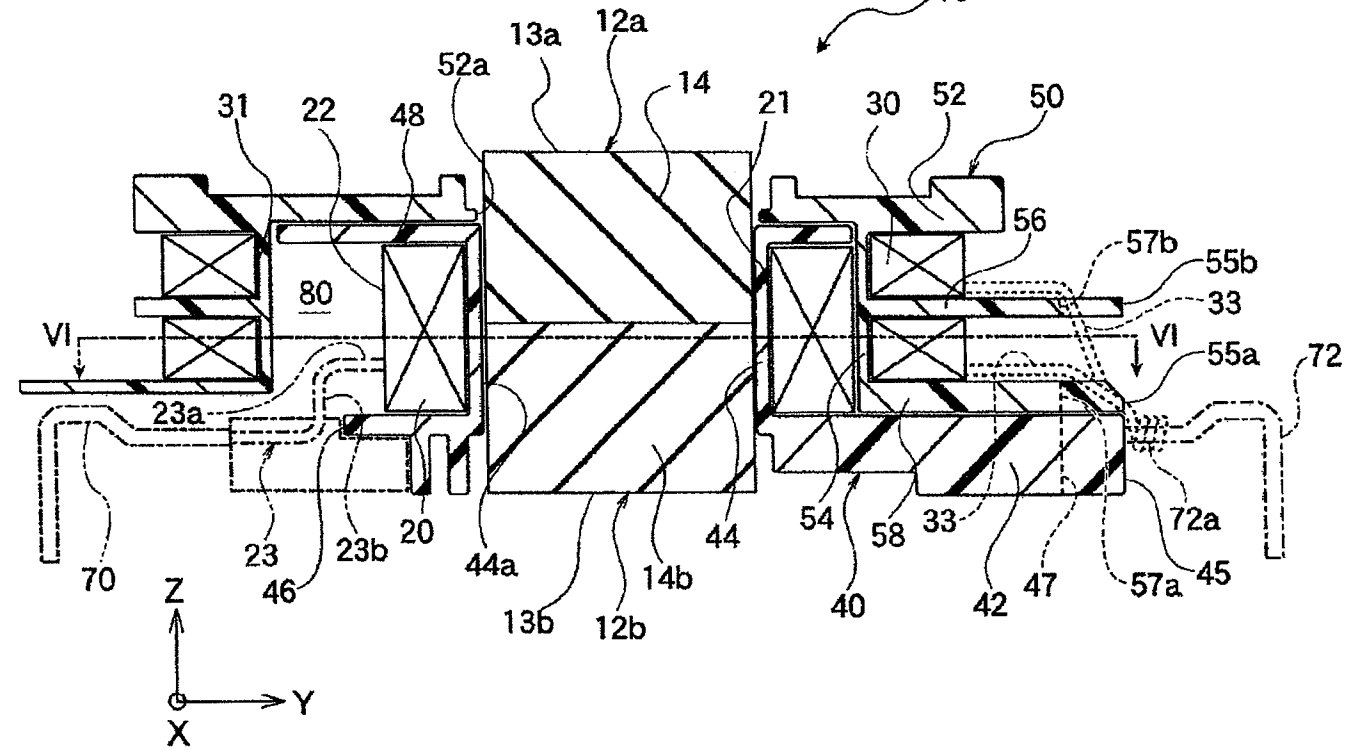
FIG. 5 is a cross-sectional view of a coil device corresponding to a cut section V shown in FIG. 1.
Figure 6:
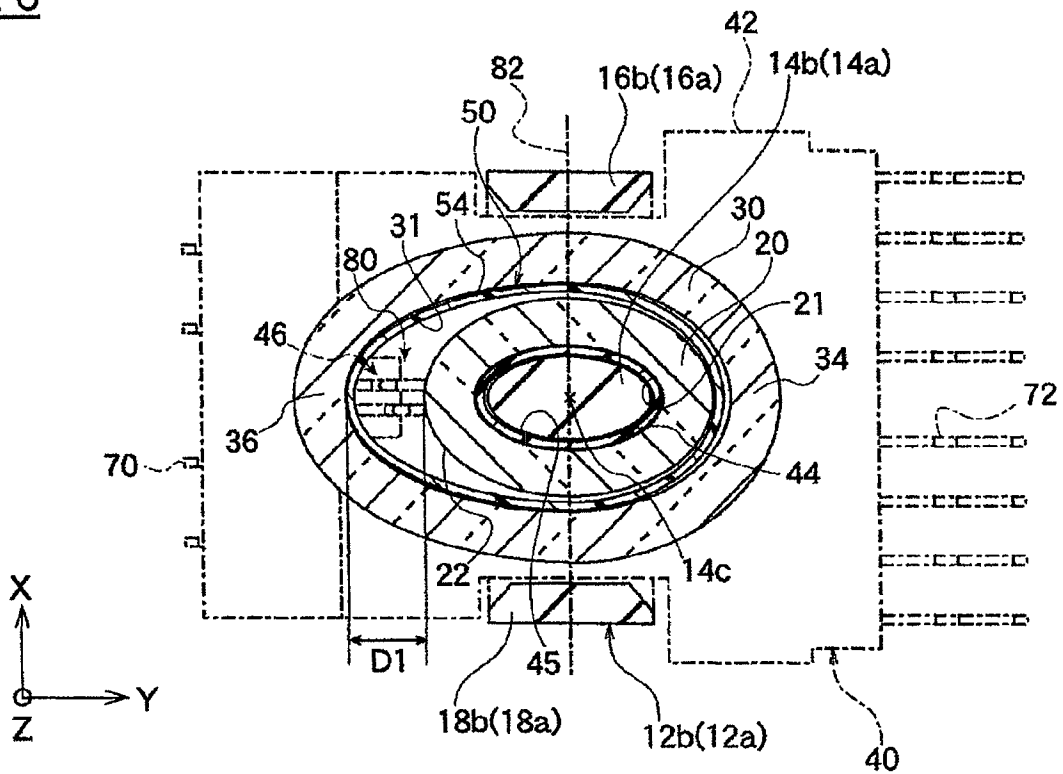
FIG. 6 is a cross-sectional view of a coil device along a VI-VI line shown in FIG. 5.

Although it is abbreviated in FIG. 2, the primary coil 20 is wound at the outer circumference of the first hollow cylinder 44 as shown in FIGS. 5 and 6. The first hollow cylinder 44 functions as a bobbin body of the primary coil 20.

Figure 3:
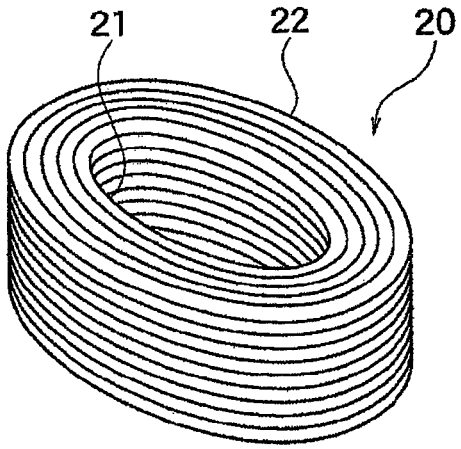
FIG. 3 is a perspective view of a primary coil.

FIG. 3 shows a perspective view of the primary coil 20. As shown in FIGS. 5 and 6, an inner perimeter edge 21 of the primary coil 20 corresponds to an outer perimeter shape of the first hollow cylinder 44, and its cross-section has an elliptical shape as shown in FIG. 6. The cross-section of an outer perimeter edge 22 of the primary coil 20 has an elliptical shape with a major axis and a minor axis which are longer than the inner perimeter edge 21, as shown in FIG. 6. Further, as shown in FIG. 6, the outer perimeter edge 22 of the primary coil 20 is formed to fit inside a second hollow cylinder 54 of the case 50 which is described later.

As shown in FIG. 2, concave parts 43 are formed, allowing passages of side legs 16*b*, 18*b* of core 12*b*, on both sides of X-axis direction of the bobbin plate 42 and at the same position of Y-axis direction as the first hollow cylinder 44. Further, engaging projections 49 are formed, removably engaging with engaging holes 59*a* of case 50 which is described later, on both sides of X-axis direction of the bobbin plate 42, more specifically on both sides of the concave parts 43.

Figure 4:
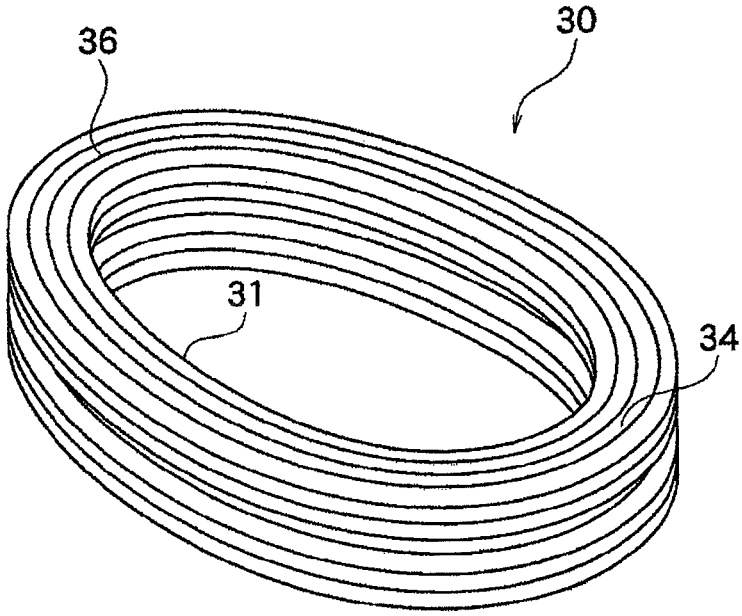
FIG. 4 is a perspective view of a secondary coil.

As shown in FIG. 2, the case 50 determines a part of an outer shape of the coil device 10, along with holding a secondary coil 30 (refer to FIG. 4 and so on). As shown in FIGS. 5 and 6, the case 50 comprises the second hollow cylinder 54 to which the secondary coil 30 is wound. The second hollow cylinder 54 functions as a bobbin body of the secondary coil 30.

On the upper end of Z-axis direction of the second hollow cylinder 54, an upper collar part 52 is formed along the plane of the X-Y axes. The upper collar part 52 is mounted opposing to the bobbin plate 42 of bobbin 40, and is extended in parallel with the mounting surface.

As shown in FIG. 2, a through hole 52*a* is formed on the upper collar part 52 in order that a middle leg 14*a* of core 12*a* can be inserted. Further, an installation groove 52*b* is formed on the upper collar part 52 in order to install a base portion 13*a* of core 12*a*.

Although it is not shown in FIG. 2, as shown in FIGS. 5 and 6, the second hollow cylinder 54 of case 50 projects vertically from the under surface of the upper collar part 52 downward in the Z-axis direction. The second hollow cylinder 54 has a shape to cover a bobbin collar 48 shown in FIG. 2 from the outer circumference, and that enables a primary coil 20 and a middle leg 14*a* (14*b*) to fit inside, as shown in FIG. 6. In other words, the inside of the second hollow cylinder 54 is insertable by the middle leg 14*a* (14*b*) and the primary coil 20.

As shown in FIGS. 2 and 5, a rectangular lower collar part 58 is formed along the plane of the X-Y axes on the lower end of Z-axis direction of the second hollow cylinder 54. The lower collar part 58 is attached to cover the upper surface of the bobbin plate 42 of bobbin 40.

Side surface parts 59 projecting downward in the Z-axis direction are formed on both sides end of X-axis direction of the lower collar part 58. Engaging holes 59*a* which engage with engaging projections 49 of bobbin 40 are formed on the side surface parts 59. Further, as is the same with the bobbin plate 42 of bobbin 40, concave parts 58*a* are formed, allowing passages of side legs 16*b*, 18*b* of core 12*b*, on both sides of X-axis direction of the lower collar part 58.

As shown in FIG. 5, an intermediate collar part 56 or more, to divide the secondary coil 30 along the Z-axis direction, are placed on the outer circumference of the second hollow cylinder 54 which is placed between the upper collar part 52 and the lower collar part 58 in accordance with the use etc. of a coil device 10. These collar parts 52, 56, 58 are placed along the plane of the X-Y axes. These collar parts 52, 56, 58, and a case 50 composed of the second hollow cylinder 54 are integrally formed by an injection molding and the like. As shown in FIG. 5, the coil device 10 has a double structure, wherein a primary coil 20 and a secondary coil 30 go doubly-around the circumference of a middle leg 14*a* (14*b*) of core 12*a* (12*b*).

As shown in FIG. 6, a cross-sectional shape of the second hollow cylinder 54 has an egg-shape, such as deforming an ellipse so that the curvature of both ends of its major axis to be asymmetric. Note that an internal shape of the coil device 10 will be mentioned hereinafter.

FIG. 4 is a perspective view of the secondary coil 30 which winds around the second hollow cylinder 54. According to the present embodiment, although the secondary coil 30 is composed of the two independent coils, it may be composed of one coil or of 3 or more coils. A secondary coil inner perimeter edge 31, an inner perimeter edge of the secondary coil 30, contacts with the second hollow cylinder 54. A winding shape of the secondary coil inner perimeter edge 31 is an egg-shape, as is the same with the cross-sectional shape of the second hollow cylinder 54.

A tip end portion 55*a* in the Y-axis direction of the lower collar part 58 of case 50 extends to one end portion 45 of Y-axis direction of the bobbin plate 42 wherein a secondary terminal 72 is formed, as shown in FIGS. 1, 2 and 5. Plural first grooves 57*a* for leads, guiding a lead wire 33 of the secondary coil 30 to a connection part 72*a* with the secondary terminal 72, are formed along the X-axis direction.

Furthermore, in the present embodiment, the first groove 57*a* for leads guides the lead wire 33, and a second groove 47 for leads, further guiding the lead wire 33 to the connection part 72*a* with the secondary terminal 72, is formed among the secondary terminals 72 which are placed at the end portion 45 of the bobbin plate 42.

In addition, a tip end portion 55*b* of the intermediate collar part 56 is also extended to the end portion 45 of the bobbin plate 42 wherein the secondary terminal 72 is formed, as is the same with the tip end portion 55*a* of the lower collar part 58. Further, a third groove 57*b* for leads, guiding the lead wire 33 of the secondary coil 30 to the connection part 72*a* with the secondary terminal 72, is formed on a tip end portion 55*b* of the intermediate collar part 56, as is the same with the tip end portion 55*a* of the lower collar part 58.

In this embodiment, although the first groove 57*a*, the second groove 47 and the third groove 57*b* for leads are formed on generally the same position of the X-axis direction and also in the same depth in the Y-axis direction corresponding to the number of the secondary terminal 72, it is not necessarily to correspond to the number of the secondary terminal 72.

Further, for the tip end portion 55*a* of the lower collar part 58, the tip end portion 55*b* of the intermediate collar part 56 and a end portion of the bobbin plate 42, there is no need to accurately align their positions in the Y-axis direction. There may be a position gap of the groove depth of each groove 57*a*, 57*b*, 47 of the Y-axis direction as long as the gap remains within the range of partly overlapped. Further, the positions of the tip end portion 55*a* of the lower collar part 58 and the end portion of the bobbin plate 42 may be shifted in a positional relation that enables the lead wire 33 to engage on both grooves 57*a* and 47. Furthermore, the positions of the tip end portion 55*b* of the intermediate collar part 56 and the end portion of the bobbin plate 42 may be shifted in a positional relation that enables the lead wire 33 to engage on both grooves 57*b* and 47. In addition, the positions of the tip end portion 55*a* of the lower collar part 58, the tip end portion 55*b* of the intermediate collar part 56 and the end portion of the bobbin plate 42 may be shifted in a positional relation that enables the lead wire 33 to engage on all grooves 57*a*, 57*b* and 47.

The coil device 10 according to the present embodiment is produced by assembling each part shown in FIG. 2, and winding the wire around bobbin 40 and case 50. Below, an example of producing method of the coil device 10 is described with using FIG. 2 and so on. When producing the coil device 10, firstly, a bobbin 40 mounted with a primary terminal 70 and a secondary terminal 72 is prepared. Although materials of bobbin 40 are not particularly limited, it can be formed with an insulation material such as resin.

Next, wire is wound around the first hollow cylinder 44 of bobbin 40 and a primary coil 20 (refer to FIG. 3) is formed. Although a wire used to form the primary coil 20 is not particularly limited, litz wire and the like are preferably used. Further, a primary lead wire 24, which is a terminal portion of the wire when forming the primary coil 20, passes a connecting path 46 of bobbin 40, and tangles with primary terminal 70 to connect (refer to FIG. 7 and the like).

Next, case 50 shown in FIG. 2 is mounted on bobbin 40 wherein the primary coil 20 is formed. Case 50 and bobbin 40 are assembled by engaging the engaging holes 59*a* of case 50 with engaging projections 49 of bobbin 40. Further, case 50 and bobbin 40 are fixed by bonding adhesive and so on when required. Materials of case 50 are not particularly limited, and can be formed with an insulation material such as resin.

Next, wire is wound around the second hollow cylinder 54 of case 50, and a secondary coil 30 (refer to FIG. 4) is formed. Although wires used to form the secondary coil 30 are not particularly limited, litz wire and the like are preferably used. A secondary lead wire 33, which is a terminal portion of wire when forming the secondary coil 30, hooks on the first groove 57*a* or third groove 57*b* for leads and winds around the connection part 72*a* of the secondary terminal 72. With this, it enables to make a winding process easier and also enables to automate that process.

Further, by locking mutually adjacent lead wires 33 on the first groove 57*a* or the third groove 57*b* for different leads, a mutual insulation characteristic of adjacent lead wires 33 can be well maintained. Furthermore, the lead wire itself is insulated by the use of insulating coating and the like. Therefore, plural lead wires 33 may be hooked on the same first groove 57*a* or the same third groove 57*b* for leads. In addition, according to the present embodiment, the process that an end portion of lead wire 33 winds around the connection part 72*a* of the secondary terminal 72 becomes easier since the second groove 47 is also formed on the end portion 45 of bobbin plate 42.

Next, a first core 12*a* and a second core 12*b* are mounted to an intermediate assembly, wherein primary coil 20, secondary coil 30, case 50 and bobbin 40 are assembled, from the vertical direction of Z-axis direction to form core 12. Specifically, each tip end of middle legs 14*a*, 14*b* of the first core 12*a* and the second core 12*b*, each tip end of side legs 16*a*, 16*b*, each tip end of side legs 18*a*, 18*b* are bond together. Further, there may be a gap between tip ends of middle legs 14*a* and 14*b*.

As for a material of core 12, soft magnetic materials such as metal, ferrite and the like are exemplified. However, it is not particularly limited. First core 12*a* and second core 12*b* are bonded together by using a bonding adhesive or their outer circumference is wound by a tape, in order to fix to case 50 and bobbin 40. Note that, after a set of assembly process, varnish impregnation may be performed to coil device 10. With these processes, coil device 10 according to the present embodiment can be produced.

As shown in FIG. 5, the coil device 10 is a vertical type, wherein the Z-axial direction (flux flowing direction) of middle leg 14*a* (14*b*) is vertical to the mounting surface. According to coil device 10 of vertical type, as shown in FIGS. 1 to 5, base portions 13*a*, 13*b* of core 12 are placed upward and downward directions of the Z-axis of the first and the secondary coils 20, 30, and that these base portions 13*a*, 13*b* suppress leakage flux toward upward and downward directions. Therefore, leakage flux of coil device 10 toward upward and downward directions can be suppressed, compared to a horizontal type wherein upward and downward directions of coil are hardly shielded by core.

Further, as shown in FIG. 5, coil device 10 has a double structure wherein the secondary coil 30 goes around the outer circumference of the primary coil 20. With the double structure, length of axial direction of core 12 in coil device 10 can be shortened, and that vertical type as well as thin type coil can be realized.

Therefore, the coil device 10 can prevent occurrence of eddy current on surrounding constructional materials and the like, without implementing aluminum shield and the like. Further, by preventing occurrence of eddy current, the coil device 10 can decrease occurrence of heat or noise associated with said occurrence of eddy current. Further, the coil device 10 does not require a shield to shield leakage flux, and therefore it can obtain a favorable heat dissipation characteristic. Furthermore, the coil device 10 provides short length middle leg 14 and side legs 16, 18 of core 12, and that enables to prevent damages of core 12 caused by external impact and the like.

At this point, the coil device having a double structure according to prior arts comprises a primary coil that its outer circumference is covered with the secondary coil. Therefore, when wiring from the primary coil to a terminal, it is necessary to implement it with arranging the secondary coil above and below. However, when trying to realize the above wiring with the coil device according to prior arts, there was a problem that either thinning or insulation characteristic will be deteriorated.

For instance, when wiring of the primary coil 20 is pulled downward in a vertical direction from the primary coil 20 so that it penetrates the bobbin plate 42 of bobbin 40, a creepage distance between the base portion 13 of core 12 and a primary lead wire 23 becomes small, and then there occurs a problem that it becomes difficult to ensure insulation characteristics.

The coil device 10 according to the present embodiment provides an intermediate region 80 between a primary coil outer perimeter edge 22 and a secondary coil inner perimeter edge 31, by making the distance between the primary coil outer perimeter edge 22 and the secondary coil inner perimeter edge 31 change along the circumferential direction. A primary lead wire 23 of the primary coil 20 is provided in this intermediate region 80, and this enables the coil device 10 to achieve a simple wiring from the primary coil 20 to the primary terminal 70 and also to increase the creepage distance between core 12 and the primary lead wire 23.

As shown in FIG. 6, a winding shape of the primary coil 20 is an ellipse shape, and the minor axis direction of the ellipse shape is parallel to the first direction (X-axis direction) which is an array direction of middle leg 14 and side legs 16, 18. Therefore, the primary coil 20 is bilaterally symmetric with respect to a reference axis 82 which is parallel to the first direction and passes through the central axis 14*c* of middle leg 14 of core 12.

Further, a winding shape of the secondary coil 30 is an egg shape, and the major axis direction and the minor axis direction of the egg shape correspond with that of the ellipse shape which is a winding shape of the primary coil 20. Namely, the major axis of the egg shape of the secondary coil 30 is vertical to the first direction, which is an array direction of middle leg 14 and side legs 16, 18. The secondary coil 30 comprises a winding bottom 34 which is located on one end portion of the major axis, and a winding top 36 which is located on the other end portion and has a larger curvature (curvature radius is small) than the winding bottom 34. Therefore, the secondary coil 30 is bilaterally unsymmetric with respect to the reference axis 82.

At the inner circumference side of the winding top 36 of the secondary coil 30, the distance between a primary coil outer perimeter edge 22 and a secondary coil inner perimeter edge 31 becomes long, and the intermediate region 80 will be large. On the other hand, at an inner circumference side of the winding bottom 34 of the secondary coil 30, the primary coil outer perimeter edge 22 is positioned proximally to the secondary coil inner perimeter edge sandwiching the second hollow part 54, and the intermediate region 80 is small. Maximum value D1 of a distance between the primary coil outer perimeter edge 22 and the secondary coil inner perimeter edge 31 is adjusted according to a required creepage distance D2 and the like (refer to FIG. 7 and the like).

As mentioned above, in the coil device 10, winding shapes of the primary coil 20 and the secondary coil 30 are made different from each other. With this, it enables the distance between the primary coil outer perimeter edge 22 and the secondary coil inner perimeter edge 31 to vary along the circumferential direction to form the intermediate region 80. Note that the intermediate region 80 may be formed by displacing a center position of the secondary coil 30 from the central axis 14*c* of middle leg 14.

Figure 7:
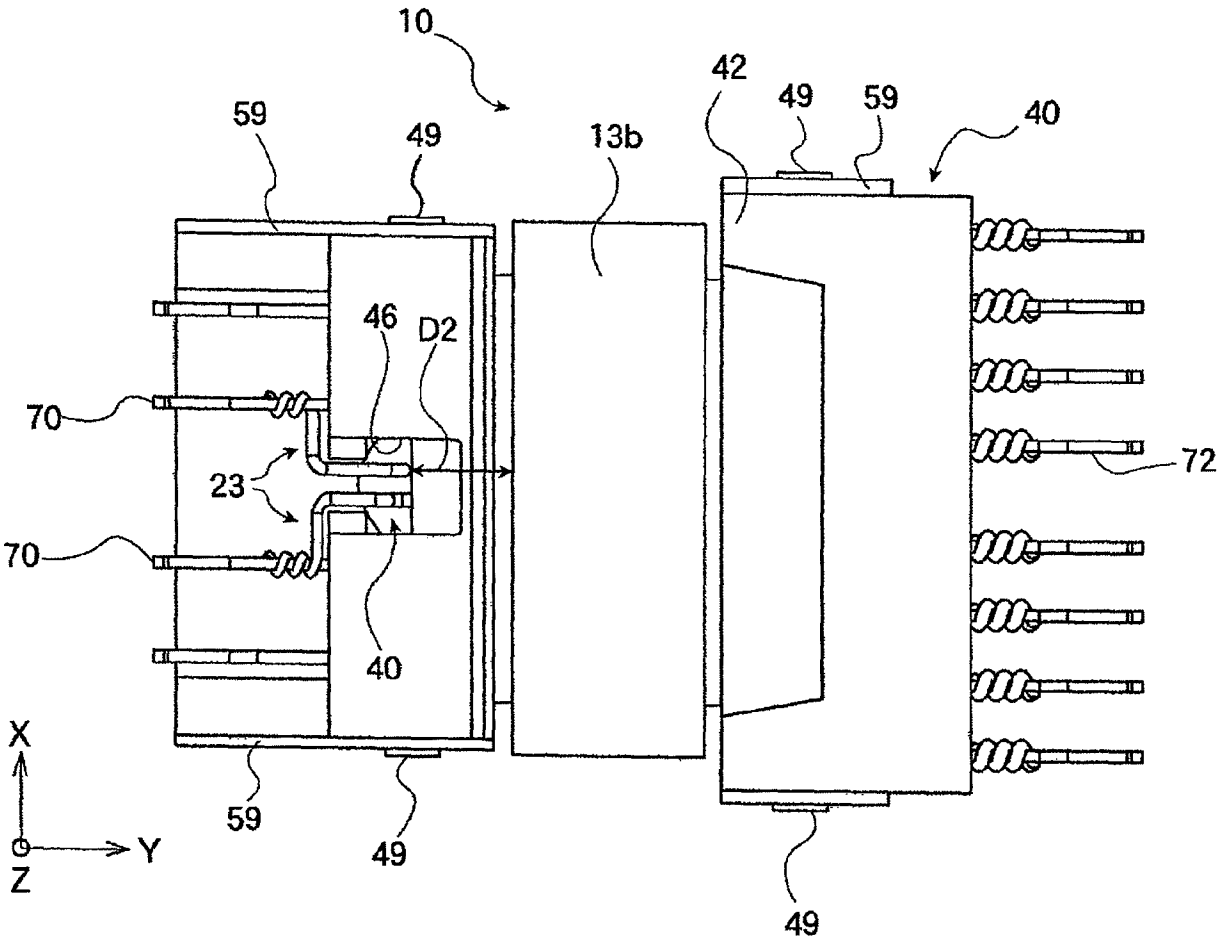
FIG. 7 is a bottom view of a coil device shown in FIG. 1.

As shown in FIG. 5, the primary lead wire 23 connects the primary terminal 70 and the primary coil 20 which is mounted to the bobbin 40. As shown in FIGS. 2 and 6, a connecting path 46, which communicates from the external of the coil device 10 to the intermediate region 80, is formed on the bobbin plate 42 of bobbin 40. The connecting path 46 is configured with a cutout, a through hole, a groove and the like formed on the bobbin plate 42. As shown in FIG. 7, the primary lead wire 23 passes the connecting path 46, and connects the primary coil 20 and the primary terminal 70.

As shown in FIG. 5, the primary lead wire 23 comprises a horizontal lead part 23*a* which is pulled out from the primary coil outer perimeter edge 22 in a parallel direction of the mounting surface, and a vertical lead part 23*b* which is pulled out from the horizontal lead part 23*a* in a vertical direction of the mounting surface. The horizontal lead part 23*a* is positioned in the intermediate region 80, while the vertical lead part 23*b* passes the connecting path 46 and is positioned over the external and the internal of the intermediate region 80.

FIG. 7 is a bottom view, in which the coil device 10 is observed from below. The primary lead wire 23 is pulled to the Y-axis direction of bobbin 40 by the horizontal lead part 23*a* shown in FIG. 5, and then passes the connecting path 46 and is exposed to the bottom side of the coil device 10. Therefore, the coil device 10 can provide preferable insulation characteristic, due to a long creepage distance D2 between a base portion 13*b* of core 12 and the primary lead wire 23. For instance, the creepage distance D2 may be 4 to 12 mm or so. Further, in the coil device 10, the creepage distance D2 can be adjusted by adjusting shapes and sizes of the intermediate region 80 and a position of the connecting path 46.

Further, in the present embodiment, there is no need to mount terminals on case 50, since the primary terminal 70 and the secondary terminal 72 are formed on the bobbin plate 42. With this, it enables to flexibly design a shape of case 50, and design flexibility is increased and also low height profile becomes easy. Along with that, it enables to select relatively economical resin for case 50 and also enables a reduction of production cost compared with the bobbin 40. Further, for the bobbin 40 wherein the terminals 70, 72 are formed, a heat resistance is required in order for solder treatment to the terminals 70, 72.

Second Embodiment

Figure 8:
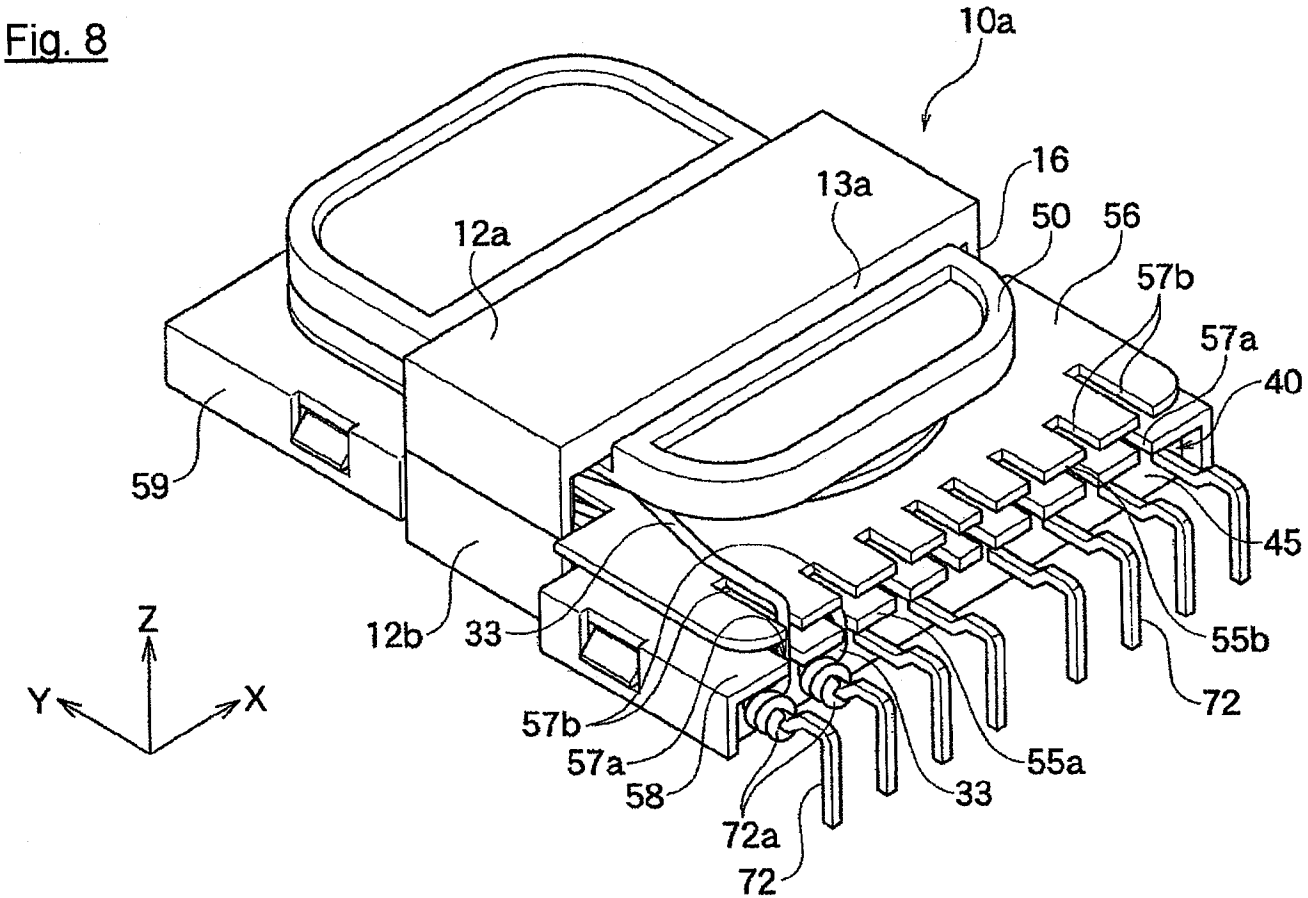
FIG. 8 is an overall perspective view of a coil device according to other embodiments of the present invention.
Figure 9:
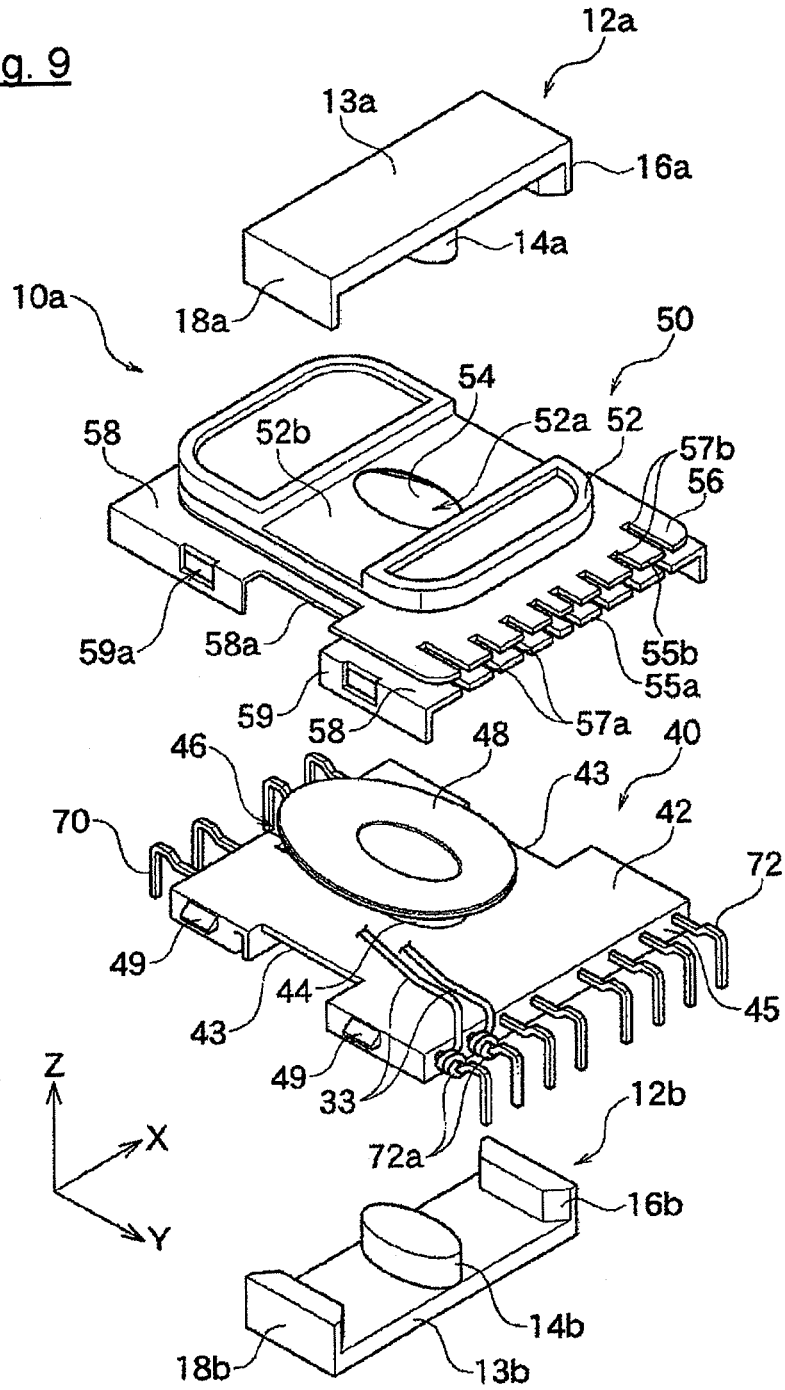
FIG. 9 is an exploded perspective view of a coil device shown in FIG. 8.

As shown in FIGS. 8 and 9, in the second embodiment, a coil device 10*a* is constituted as is the same with the first embodiment, except for the followings. Further, common codes are added to common parts, and the explanation for that is abbreviated.

In the present embodiment, as shown in FIGS. 8 and 9, a tip end portion 55*a* of lower collar part 58 of case 50 and a tip end portion 55*b* of intermediate collar part 56 project in the Y-axis direction, with respect to an end portion 45 of the bobbin plate 40. In this embodiment, first grooves 57*a* for lead are formed on a tip end portion 45*a* of the projecting lower collar part 58 and third grooves 57*b* for lead are formed on a tip end portion 45*b* of the intermediate groove 56.

Therefore, in the present embodiment, the process, that an end portion of lead wire 33 winds around a connection part 72*a* of the secondary terminal 72 by engaging it on the first groove 57*a* and the third groove 57*b* for leads, is easy without forming the second grooves for lead on the end portion 45 of the bobbin plate 42. It is not necessary to form the second grooves for lead on the end portion 45 of the bobbin plate 42 and it becomes easy to form the bobbin 40. With this, it enables a reduction of production cost and also enables to improve the strength of the bobbin 40.

Further, in the abovementioned first and second embodiments, although a cross-sectional shape of middle leg 14*a* (14*b*) of core 12 is an ellipse shape, it is not particularly limited and may be a circular, polygonal or other shapes. Furthermore, for a winding shape of the primary coil 20 and the secondary coil 30, it is not particularly limited and it also may be a circular, polygonal or other shapes.

In addition, the terms "primary" and "secondary" for coils, lead wires and terminals are used for a reason of expediency. In the present invention, a coil attached to bobbin 40 is referred to as a primary coil, and a coil attached to a case is referred to as a secondary coil. The primary coil does not need to be an input side, it may be an output side and the secondary coil may be an input side.

Furthermore, according to present invention, the secondary coil 30 does not need to be bilaterally asymmetric with respect to the reference axis 82, and it may be symmetric with respect to the reference axis 82 as long as leading of primary lead wire 23 is ensured.

EXPLANATION OF CODES

10—coil device
12—core
12*a* —first core
12*b* —second core
13*a*, 13*b* —base portion
14—middle leg
14*c* —central axis
16, 18—side leg
20—primary coil
21—primary coil inner perimeter edge
22—primary coil outer perimeter edge
23—primary lead wire
23*a* —horizontal lead part
23*b* —vertical lead part
30—secondary coil
31—secondary coil inner perimeter edge
33—secondary lead wire
34—winding bottom
36—winding top
40—bobbin
42—bobbin plate
42*a* —groove
44—first hollow cylinder
45—end portion
46—connecting path
47—second groove for lead
48—bobbin collar part
49—engaging projection
50—case
52—upper collar part
52*a* —through hole
54—second hollow cylinder
55*a*, 55*b* —tip end portion
56—intermediate collar part
57*a* —first groove for lead
57*b* —third groove for lead
58—lower collar part
59—side surface parts
59*a* —engaging hole
70—primary terminal
72—secondary terminal
80—intermediate region

The invention claimed is:

1. A coil device comprising a bobbin having a bobbin plate provided with a first hollow cylinder, on which a primary coil is wound at an outer circumference, and a case provided with a second hollow cylinder readily mounted on an outer circumference of said primary coil and wound by a secondary coil at an outer circumference, and provided with a lower collar part which is formed at a lower end of said second hollow cylinder so as to be mounted on an upper surface of said bobbin plate, wherein on one end portion of said bobbin plate in a longitudinal direction, a plurality of primary terminals connecting to said primary coil are formed projecting out along the longitudinal direction of said bobbin plate, and on the other end portion of said bobbin plate in the longitudinal direction, a plurality of secondary terminals connecting to said secondary coil are formed projecting out along the longitudinal direction of said bobbin plate, and a tip end portion of the lower collar part of said case at a side of the secondary terminal is extended at least to the other end portion of said bobbin plate in a longitudinal direction to which said secondary terminal is formed, and plural first grooves for lead, which guide a lead wire of said secondary coil to a connection part with said secondary terminal, are formed on said tip end portion, a distance between the outer circumference of said primary coil and an inner circumference of said secondary coil changes along a circumferential direction and an intermediate region that passes a primary lead wire of said primary coil is provided between the outer circumference of said primary coil and the inner circumference of said secondary coil, at an inner circumference side of a winding bottom of said secondary coil, said outer circumference of said primary coil is positioned proximally to said inner circumference of said secondary coil sandwiching said second hollow cylinder, at the inner circumference side of the winding top of said secondary coil, the distance between the outer circumference of said primary coil and inner circumference of said secondary coil increases so that the intermediate region is made therebetween, and the primary lead wire of said primary coil passes through the intermediate region and is connected to the primary terminals.

2. The coil device as set forth in claim 1, wherein a second groove for lead, further guiding said lead wire which is guided by said first groove for lead to the connection part with said secondary terminal is formed on the end portion of said bobbin plate, and the tip end portion of the lower collar part of said case at the side of the secondary terminal is extended at least to the position where the tip end portion of the lower collar part overlaps with said second groove for lead.

3. The coil device as set forth in claim 1 or 2, wherein the tip end portion of the lower collar part of said case at the side of the secondary terminal projects, either equaling or surpassing the end portion of said bobbin plate.

4. The coil device as set forth in claim 1, wherein said first grooves for lead are formed on the tip end portion of said lower collar part at the side of the secondary terminal along the end portion of said bobbin plate.

5. The coil device as set forth in claim 1, wherein an upper collar part is formed on the upper end of said second hollow cylinder of said case, at least one intermediate collar part is formed on the outer circumference of said second hollow cylinder which is located between said upper collar part and said lower collar part, and a tip end portion of said intermediate collar part is extended to the end portion of said bobbin plate on which said secondary terminal is formed, and a third groove for lead guiding a lead wire of said secondary coil to a connection part with said secondary terminal is formed on the tip end portion of said intermediate collar part.

6. The coil device as set forth in claim 1, wherein middle legs of a pair of ferrite cores are respectively inserted into a through hole of said first hollow cylinder, from top and bottom of said first hollow cylinder, and side legs and base portions of the pair of ferrite cores are assembled to cover a part of said case and bobbin from the outer circumference.

7. The coil device as set forth in claim 1, wherein a winding shape of said primary coil is an ellipse shape, a winding shape of said secondary coil is an egg shape and a major axis direction and a minor axis direction of the egg shape corresponds with that of the ellipse shape which is a winding shape of said primary coil, said secondary coil comprises the winding bottom which is located on one end portion of the major axis, and a winding top which is located on the other end portion and has a larger curvature than the winding bottom, and the distance between said primary coil outer perimeter edge and said secondary coil inner perimeter edge becomes long and the intermediate region is formed at the inner circumference side of the winding top of said secondary coil.

8. The coil device as set forth in claim 1, wherein winding shapes of said primary coil and said secondary coil are made different from each other.

9. The coil device as set forth in claim 1, wherein said primary coil is bilaterally symmetric with respect to a reference axis, and said secondary coil is bilaterally asymmetric with respect to said reference axis.

* * * * *